US006743997B2

(12) United States Patent
Schmidt et al.

(10) Patent No.: US 6,743,997 B2
(45) Date of Patent: Jun. 1, 2004

(54) ROCKER SWITCH

(75) Inventors: Robert M. Schmidt, Livonia, MI (US); Charles Bruce Banter, Northville, MI (US); Mark G. Feldman, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/213,931

(22) Filed: Aug. 6, 2002

(65) Prior Publication Data

US 2004/0026223 A1 Feb. 12, 2004

(51) Int. Cl.[7] ..... H01H 15/00

(52) U.S. Cl. ..... 200/553; 200/6 R; 200/16 R; 200/547

(58) Field of Search ..... 200/6 R, 16 R, 200/1 V, 547, 551, 553, 557, 558, 16 A, 6 B

(56) References Cited

U.S. PATENT DOCUMENTS

| | | | | |
|---|---|---|---|---|
| 3,243,562 A | | 3/1966 | O'Brien | 200/166 |
| 3,274,355 A | | 9/1966 | Francy | 200/77 |
| 3,352,980 A | * | 11/1967 | Rougemont et al. | 200/16 D |
| 3,767,870 A | * | 10/1973 | Marquardt | 200/6 R |
| 3,959,611 A | | 5/1976 | Greene et al. | 200/5 A |
| 4,272,662 A | * | 6/1981 | Simpson | 200/275 |
| 4,329,552 A | | 5/1982 | McConnell | 200/147 R |
| 4,371,767 A | | 2/1983 | Ohashi et al. | 200/335 |
| 4,383,149 A | * | 5/1983 | Fulton | 200/437 |
| 4,525,607 A | * | 6/1985 | Senoh | 200/16 R |
| 4,605,830 A | | 8/1986 | Reid | 200/73 |
| 4,778,964 A | | 10/1988 | Kamisada | 200/284 |
| 4,780,580 A | * | 10/1988 | Sawada | 200/438 |
| 4,851,625 A | * | 7/1989 | Liebich | 200/551 |
| 4,947,008 A | * | 8/1990 | Sato et al. | 200/6 R |
| 5,712,611 A | | 1/1998 | Mattes et al. | 337/334 |
| 5,796,058 A | | 8/1998 | Aimi et al. | 200/16 D |
| 6,066,815 A | | 5/2000 | Spedale | 200/51.03 |
| 6,072,139 A | | 6/2000 | Nakase et al. | 200/558 |

* cited by examiner

*Primary Examiner*—Michael A. Friedhofer
(74) *Attorney, Agent, or Firm*—Bill C. Panagos

(57) ABSTRACT

A rocker switch for operating a direct current motor includes a base, an actuator, a contactor, and a plurality of contact points. The contact points are made of formed wires extending into the base and having outer walls that form the contact points. The plurality of contact points includes a first contact and a second contact that are connected by the contactor when the contactor is moved to an actuated position by moving the actuator to an actuated position.

7 Claims, 1 Drawing Sheet

ROCKER SWITCH

BACKGROUND OF THE INVENTION

1. Field of the Invention

The present invention relates to rocker switches for operating direct current (DC) motors.

2. Background Art

An existing rocker switch for operating a direct current (DC) motor is the double rocker switch used to operate a reversible DC motor for automotive power windows, automotive power seat or similar applications. The double rocker switch design requires two movable contact systems that are aligned parallel and 180° opposite. The movable member, or contactor, rests on a fixed conductive pivot tied to a motor leg and a fixed conductive point tied to ground. When actuated, the contactor rotates about the fixed pivot until it touches a fixed contact point tied to battery positive, or B+. When actuation is stopped, the contactor breaks connection with the B+ point (this results in an electrical arc between the B+ point and the contactor due to energy dissipated from the DC motor) and returns to the rest position.

Currently, B+ points are riveted, brazed or welded to a conductive trace. Pivot points and grounds are typically formed from silver plated copper strip, then insert molded. These techniques for the contact points have associated material and processing costs. Some additional background on various types of switches is found in U.S. Pat. Nos. 3,243,562; 3,274,355; 3,959,611; 4,329,552; 4,371,767; 4,605,830; 4,778,964; 5,712,611; 5,796,058; 6,066,815; and 6,072,139.

There is a need for an improved rocker switch that allows a reduction in material and processing costs.

SUMMARY OF THE INVENTION

It is, therefore, an object of the present invention to provide an improved rocker switch for operating a direct current motor.

In carrying out the above object, a rocker switch for operating a direct current motor is provided. The rocker switch comprises a base, an actuator, a contactor, and a plurality of contact points. The actuator is received on the base and movable relative to the base between an actuated position and a deactuated position. The contactor is received between the base and the actuator and arranged to move between an actuated position and a deactuated position when the actuator is moved. The plurality of contact points are made of formed wires extending into the base and having outer walls that form the contact points. The plurality of contact points include a first contact and a second contact that are connected by the contactor when the contactor is moved to the actuated position by moving the actuator to the actuated position.

Preferably, the first contact is a pivot point upon which the contactor pivots into selective contact with the second contact when the contactor is moved to the actuated position. More preferably, the plurality of contact points includes a third contact and the contactor pivots into selective contact with the third contact when the contactor is moved to the deactuated position.

In a preferred embodiment, the actuator is movable relative to the base among a forward actuated position, the deactuated position, and a reverse actuated position. The contactor includes a first contactor and a second contactor. The first contactor is arranged to move between an actuated position and a deactuated position when the actuator is moved between the forward actuated position and the deactuated position. The second contactor is arranged to move between an actuated position and a deactuated position when the actuator is moved between the reverse actuated position and the deactuated position. The plurality of contact points include a first contact and a second contact that are connected by the first contactor when the first contactor is moved to the actuated position by moving the actuator to the forward actuated position. The plurality of contact points include a third contact and a fourth contact that are connected by the second contactor when the second contactor is moved to the actuated position by moving the actuator to the reverse actuated position.

Preferably, the first contact is a pivot point upon which the first contact pivots into selective contact with the second contact when the first contactor is moved to the actuated position. Preferably, the third contact is a pivot point upon which the second contactor pivots into selective contact with the fourth contact when the second contactor is moved to the actuated position.

More preferably, the plurality of contact points includes the fifth contact and a first contactor pivots into selective contact with the fifth contact when the first contactor is moved to the deactuated position. More preferably, the plurality of contact points includes a sixth contact and the second contactor pivots into selective contact with the sixth contact when the second contactor is moved to the deactuated position.

More preferably, the rocker switch further comprises a first spring and a second spring. The first spring biases the first contactor toward the deactuated position. Moving the actuator to the forward actuated position moves the first contactor toward the actuated position against the spring bias. The second spring biases the second contactor toward the deactuated position. Moving the actuator to the reverse actuated position moves the second contactor toward the actuated position against the spring bias.

The advantages associated with embodiments of the present invention are numerous. For example, the preferred embodiment allows the fixed pivot, ground and B+ contact points to be constructed from the same alloy solid wire. Wire may be positioned perpendicular to the plane of the contactor so that the contactor touches the cylindrical wall of the wire for electrical contact. Further, the wire may be formed into a 90° bend so that it can be used as an attachment to a power distribution component such as a printed circuit board (PCB) to create an entire switch assembly.

The above object and other objects, features, and advantages of the present invention are readily apparent from the following detailed description of the preferred embodiment when taken in connection with the accompanying drawings.

DETAILED DESCRIPTION OF THE PREFERRED EMBODIMENT

Figure 1:
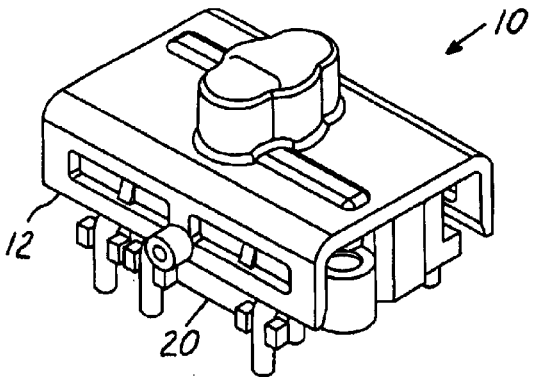
FIG. 1 is a perspective view of a preferred embodiment of a rocker switch of the present invention.
Figure 2:
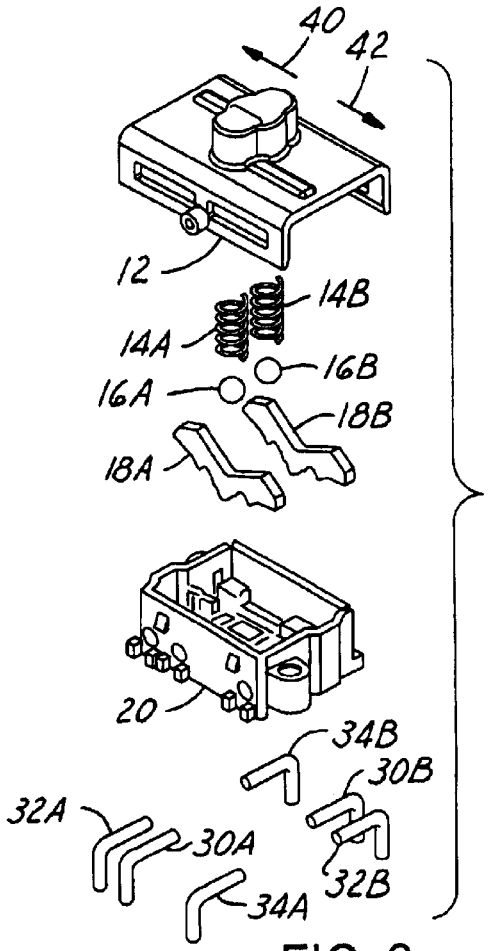
FIG. 2 is an exploded view showing the cooperation of components of the rocker switch of FIG. 1.

FIGS. 1 and 2 illustrate the preferred embodiment for a rocker switch for operating a direct current motor in accordance with the present invention. The assembled rocker switch is indicated at 10. FIG. 2 best illustrates the cooperation of the various rocker switch components. Rocker switch 10 includes an actuator 12, springs 14A, 14B and balls 16A, 16B, contactors 18A, 18B, base 20, and formed wire contact points 30A, 32A, 34A, 30B, 32B, 34B. When assembled, actuator 12 is received on base 20 and movable relative to base 20 among a forward actuated position, a deactuated position, and a reverse actuated position. Each contactor 18A, 18B is received between base 20 and actuator 12. Each contactor 18A, 18B is arranged to move between an actuated position and a deactuated position in response to movement of actuator 12.

More specifically, actuator 12 is movable relative to base 20 among a forward actuated position by sliding actuator 12 in the direction indicated by arrow 40, the deactuated position, and the reverse actuated position by sliding actuator 12 in the direction indicated by arrow 42. Contactor 18A moves between an actuated position and a deactuated position when actuator 12 is moved between the forward actuated position and the deactuated position. Contactor 18B moves between an actuated position and a deactuated position when actuator 12 moves between the reverse actuated position and the deactuated position. The plurality of contact points are made of formed wires extending into base 20 and having outer walls that form the contact points. Contact 30A and contact 32A are connected by contactor 18A when contactor 18A is moved to the actuated position by moving actuator 12 to the forward actuated position. Contact 30B and contact 32B are connected by contactor 18B by moving actuator 12 to the reverse actuated position.

Figure 3:
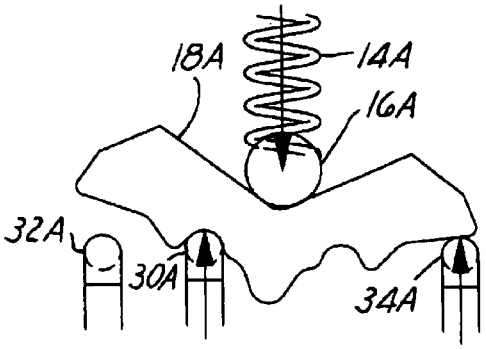
FIG. 3 is a side view showing the contactor in the deactuated position.
Figure 4:
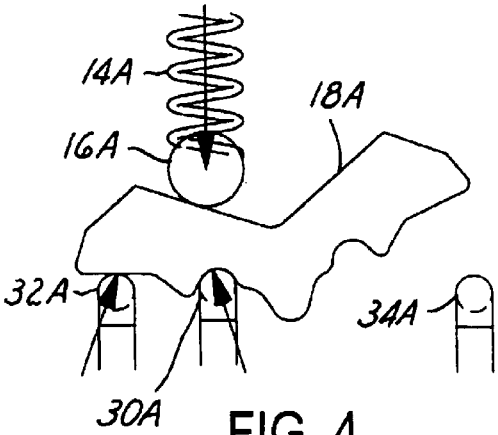
FIG. 4 is a side view showing the contactor in the actuated position.

FIGS. 3 and 4 illustrate contactor movement in a preferred embodiment and specifically show contactor 18A in the deactuated position in FIG. 3 and contactor 18A in the actuated position in FIG. 4. As shown, contact 30A is a pivot point upon which contactor 18A pivots into selective contact with contact 32A when contactor 18A is moved to the actuated position. Contactor 18A pivots into selective contact with contact 34A when contactor 18A is moved to the actuated position. Spring 14A biases contactor 18A toward the deactuated position. Moving actuator 12 to the forward actuated position moves contactor 18A toward the actuated position against the spring bias. Spring 14A biases contactor 18A via ball 16*a*. It is appreciated that the other contactor 18B, and contacts 30B, 32B, 34B and spring and ball 14B and 16B cooperate in the same manner to provide operation of the rocker switch when actuator 12 is moved between the deactuated position and the reverse actuated position to provide reversing of the direct current motor.

Figure 5:
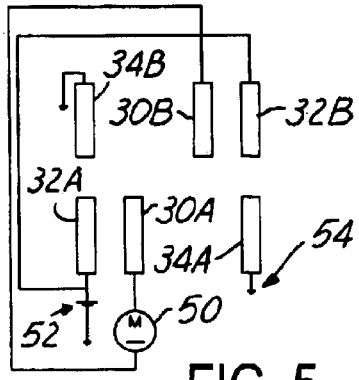
FIG. 5 is a circuit diagram illustrating an exemplary arrangement for driving a reversible direct current motor.

FIG. 5 illustrates contacts 30A, 32A, 34A, 30B, 32B, 34B in a circuit diagram with battery 52 providing positive voltage B+, ground 54, and motor 50.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A rocker switch for operating a direct current motor, the rocker switch comprising:

a base;

an actuator received on the base and moveable relative to the base between an actuated position and a deactuated position;

a contactor received between the base and the actuator and arranged to move between an actuated position and a deactuated position when the actuator is moved; and a plurality of contact points made of formed wires extending into the base and having outer walls that form the contact point, the plurality of contact points including a first contact and a second contact that are connected by the contactor when the contactor is moved to the actuated position by moving the actuator to the actuated position wherein the connection provides power to the direct current motor such that the disconnection results in an arc due to dissipation of stored energy.

2. The rocker switch of claim 1 wherein the actuator is moveable relative to the base among a forward actuated position, the deactuated position, and a reverse actuated position, the contactor including a first contactor and a second contactor, the first contactor being arranged to move between an actuated position and a deactuated position when the actuator is moved between the forward actuated position and the deactuated position, and the second contactor being arranged to move between an actuated position and a deactuated position when the actuator is moved between the reverse actuated position and the deactuated position, and wherein the plurality of contact points include a first contact and a second contact that are connected by the first contactor when the first contactor is moved to the actuated position by moving the actuator to the forward actuated position and a third contact and a fourth contact that are connected by the second contactor when the second contactor is moved to the actuated position by moving the actuator to the reverse actuated position.

3. The rocker switch of claim 2 wherein the first contact is a pivot point upon which the first contactor pivots into selective contact with the second contact when the first contactor is moved to the actuated position, and wherein the third contact is a pivot upon which the second contactor pivots into selective contact with the fourth contact when the second contactor is moved to the actuated position.

4. The rocker switch of claim 3 wherein the plurality of contact points include a fifth contact and the first contactor pivots into selective contact with the fifth contact when the first contactor is moved to the deactuated position, and wherein the plurality of contact points include a sixth contact and the second contactor pivots into selective contact with the sixth contact when the second contactor is moved to the deactuated position.

5. The rocker switch of claim 4 further comprising:

a first spring biasing the first contactor toward the deactuated position wherein moving the actuator to the forward actuated position moves the first contactor toward the actuated position against the spring bias; and a second spring biasing the second contactor toward the deactuated position wherein moving the actuator to the reverse actuated position moves the second contactor toward the actuated position against the spring bias.

6. The rocker switch of claim 1 wherein the first contact is a pivot point upon which the contactor pivots into selective contact with the second contact when the contactor is moved to the actuated position.

7. The rocker switch claim 6 wherein the plurality of contact points include a third contact and the contactor pivots into selective contact with the third contact when the contactor is moved to the deactuated position.

* * * * *